US010368422B2

(12) United States Patent
Sellam

(10) Patent No.: US 10,368,422 B2
(45) Date of Patent: Jul. 30, 2019

(54) SIGNAL-PRESERVING POWER BOOSTER AND RELATED METHOD

(71) Applicant: MEDIA GRAPH DEPOT INC., Montreal, QC (CA)

(72) Inventor: David Sellam, Mont-Royal (CA)

(73) Assignee: MEDIA GRAPH DEPOT INC., Montreal, QC (CA)

( * ) Notice: Subject to any disclaimer, the term of this patent is extended or adjusted under 35 U.S.C. 154(b) by 31 days.

(21) Appl. No.: 15/788,776

(22) Filed: Oct. 19, 2017

(65) Prior Publication Data

US 2018/0110110 A1 Apr. 19, 2018

Related U.S. Application Data

(60) Provisional application No. 62/409,906, filed on Oct. 19, 2016.

(51) Int. Cl.
*H05B 37/02* (2006.01)
*H05B 33/08* (2006.01)

(52) U.S. Cl.
CPC ..... *H05B 37/0245* (2013.01); *H05B 33/083* (2013.01); *H05B 33/0809* (2013.01); *H05B 33/0815* (2013.01)

(58) Field of Classification Search
CPC ..... H05B 37/0245; H05B 33/0809; H05B 33/083
USPC ..... 315/193
See application file for complete search history.

(56) References Cited

U.S. PATENT DOCUMENTS 7,334,917 B2 * 2/2008 Laski ..... H05B 33/0803 315/246
9,894,725 B2 * 2/2018 Aydin ..... H05B 33/0851
2005/0218838 A1 * 10/2005 Lys ..... H02M 1/4225 315/291
2017/0163345 A1 * 6/2017 Pederson ..... H04B 10/40
2017/0223796 A1 * 8/2017 Duan ..... H05B 33/0845

* cited by examiner

*Primary Examiner* — Dylan C White
(74) *Attorney, Agent, or Firm* — Gowling WLG (Canada) LLP; Benoit Yelle

(57) ABSTRACT

A signal-preserving power booster and a related method. An input module, comprises a reference port and two input ports, receives an input light signal, which conveys an input lighting power component at a first power level and a data-over-light digital stream component imperceptible to a human eye. A MOSFET amplifier module, having access to the reference port, provides an output light signal between two output ports, a first output port being connected to an internal amplifier circuit connected to the first input port and a second output port being connected to the second input port. The output light signal conveys the data-over-light digital stream component from the input light signal and an output lighting power component, at a second power level equal to or greater than the first power level, the output light signal powering an array of LEDs at the second power level.

15 Claims, 6 Drawing Sheets

SIGNAL-PRESERVING POWER BOOSTER AND RELATED METHOD

PRIORITY STATEMENT UNDER 35 U.S.C. § 119 (e) & 37 C.F.R. § 0.1.78

This non-provisional patent application claims priority based upon the prior U.S. provisional patent application entitled "SIGNAL-PRESERVING POWER BOOSTER AND RELATED METHOD", application No. 62/409,906, filed 2016 Oct. 19, in the name of SELLAM, David, which is incorporated herein in its entirety.

TECHNICAL FIELD

The present invention relates to signal power boosting and, more particularly, to power boosting while preserving the original signal.

BACKGROUND

Alexander Graham Bell and his assistant Charles Sumner Tainter tested, on Feb. 19, 1880, a telecommunications device that conveyed speech over a modulated light beam. U.S. Pat. No. 235,199 (Apparatus for Signalling and Communicating, called Photophone) was issued in December 1880, about a century before its principles came to have wide practical applications, through optical fibers.

Recently, the concept of conveying data in regular lighting has resurfaced. Instead of conveying speech as Bell had envisioned more than a century ago, lighting systems are used to convey information at a frequency that the human eye cannot perceive.

Powering LED arrays that convey information while meeting market demand for size and luminosity of such arrays is a challenge identified by the inventor.

The present invention aims at providing one or more solutions to this challenge.

SUMMARY

A first aspect of the present invention is directed to a signal-preserving power booster comprising an input module comprising a reference port and two input ports for receiving an input light signal therebetween. The input light signal conveys an input lighting power component at a first power level and a data-over-light digital stream component at a frequency imperceptible to a human eye. The signal-preserving power booster also comprises a metal oxide semiconductor field-effect transistor (MOSFET) amplifier module, having access to the reference port, comprising two output ports for providing an output light signal therebetween, a first output port of the two output ports being connected to an internal amplifier circuit connected to the first input port and a second output port of the two output ports being connected to the second input port. The output light signal conveys the data-over-light digital stream component from the input light signal and an output lighting power component, at a second power level equal to or greater than the first power level, the output light signal powering a first array of Light Emission Diodes (LEDs) at the second power level.

In some embodiments, the internal amplifier circuit comprises a plurality MOSFETs, each providing a source, a gate, a drain and a channel, wherein a logical connection links the channel and the source and a logical diode connects from the source to the drain, wherein the first of the two input ports is provided to the gate of a first MOSFET of the plurality of MOSFETs, the drain of the first MOSFET is provided to the gate of a second MOSFET of the plurality of MOSFETS and to the gate of a third MOSFET of the plurality of MOSFETS, a first voltage regulator comprising a first resistor and a first Zener diode connects the reference port, the first input port and the second input port, a second voltage regulator comprising a second resistor and a second Zener diode connects the reference port, the drain of the first MOSFET and the second input port and the drain of the second MOSFET and the drain of the third MOSFET are provided to the first output port.

A source device may connect the second input port and the reference port and provide power to a generator device providing the input light signal at the first power level between the first input port and the second input port.

In some embodiments, a second booster, in accordance with the booster discussed hereinabove, is connected to the reference port with the output light signal connected as a second input light signal of the second booster. A second output light signal then conveys the data-over-light digital stream component from the output light signal and a second output lighting power component, at a third power level equal to or greater than the second power level, the second output light signal powering a second array of LEDs at the third power level.

The source device may connect a second input port of the second booster and the reference port and serves as a single source of energy for the first array of LEDs and the second array of LEDs.

In some embodiments, a plurality of additional boosters, each in accordance with the booster previously described, are daisy chained to the reference port with the output light signal connected as a daisy-chained input light signal of a first one of the plurality of additional boosters. Each of the plurality of daisy-chained boosters provides a corresponding output signal fed to a subsequent of the plurality of additional boosters and each of the corresponding output signal conveys the data-over-light digital stream component from a precedent output light signal and a corresponding output lighting power component, at a subsequent power level equal to or greater than a second power level of a precedent of the plurality of additional boosters, the corresponding output light signal powering a corresponding array of Light Emission Diodes (LEDs) at the corresponding power level. A number of units in the plurality of additional boosters is limited by a power rating of the source device, which serves as a single source of energy for the first array of LEDs and the corresponding arrays of LEDs.

A second aspect of the present invention is directed to a method for boosting power of an input light signal towards two output ports. The method comprises receiving the input light signal between a first input port and a second input port. The input light signal conveys an input lighting power component at a first power level and a data-over-light digital stream component at a frequency imperceptible to a human eye. The method also comprises providing the first input port to a gate of a first metal oxide semiconductor field-effect transistor (MOSFET) of a plurality of MOSFETs comprising a second MOSFET and a third MOSFET, each of the plurality of MOSFETS providing a source, a gate, a drain and a channel. A logical connection links the channel and the source and a logical diode connects from the source to the drain. The method yet also comprises providing the drain of the first MOSFET to the gate of the second MOSFET and to the gate of the third MOSFET, wherein a first voltage regulator comprising a first resistor and a first Zener diode connects a reference port, the first input port and the second input port and a second voltage regulator comprising a second resistor and a second Zener diode connects the reference port, the drain of the first MOSFET and the second input port, providing the second input port to a second of the two output ports and providing the drain of the second MOSFET and the drain of the third MOSFET to a first of the two output ports. An output light signal is provided between the first output port and the second output port conveying the data-over-light digital stream component from the input light signal and an output lighting power component, at a second power level greater than or equal to the first power level.

The method may also comprise powering a first array of Light Emission Diodes (LEDs) at the second power level from the output light signal. The method may yet further comprise connecting a source device between the second input port and the reference port and connecting the source device to a generator device providing the input light signal at the first power level between the first input port and the second input port. The method may also further providing the output light signal to a second booster connected to the reference port with the output light signal connected as a second input light signal of the second booster. A second output light signal conveys the data-over-light digital stream component from the output light signal and a second output lighting power component, at a third power level equal to or greater than the second power level, the second output light signal powering a second array of Light Emission Diodes (LEDs) at the third power level. The method may also further comprise providing the second output light signal to a third booster to the reference port with the second output light signal connected as a third input light signal of the third booster. A third output light signal conveys the data-over-light digital stream component from the second output light signal and a third output lighting power component, at a fourth power level equal to or greater than a third power level, the third output light signal powering a third array of Light Emission Diodes (LEDs) at the fourth power level.

In some embodiments, the method may further comprising daisy-chaining a plurality of additional boosters to the reference port with the output light signal connected as a daisy-chained input light signal of a first one of the plurality of additional boosters, wherein each of the plurality of daisy-chained boosters provides a corresponding output signal fed to a subsequent of the plurality of additional boosters, wherein each of the corresponding output signal conveys the data-over-light digital stream component from a precedent output light signal and a corresponding output lighting power component, at a subsequent power level equal to or greater than a second power level of a precedent of the plurality of additional boosters, the corresponding output light signal powering a corresponding array of Light Emission Diodes (LEDs) at the corresponding power level and wherein a number of units in the plurality of additional boosters is limited by a power rating of a source device, which serves as a single source of energy for the first array of LEDs and the corresponding arrays of LEDs.

BRIEF DESCRIPTION OF THE DRAWINGS

Further features and exemplary advantages of the present invention will become apparent from the following detailed description, taken in conjunction with the appended drawings, in which.

DETAILED DESCRIPTION

Advertisement and marketing-driven displays have become increasingly interactive. They become even more appealing when provided on large scale displays. Providing sufficient light over such large scale displays does not pose a major problem as many different power sources driving different light sources can be put together for that purpose. However, when a signal is also conveyed by the light, providing different light sources create, among others, a source synchronization problem. Conversely, building a data-over-light generator scaled to the power requirements of large scale di splays brings unwarranted complexity.

A signal generator provides a lighting signal comprising a lighting power component at a first maximum power level and also comprises a data-over-light digital stream component at a frequency imperceptible to a human eye. Broadly speaking, the present invention allows the lighting signal from the signal generator to be boosted above a nominal maximum power of the signal generator in order to feed a larger scale display from the signal generator. This may be achieved using a single boosting device, but may also be accomplished by using a plurality of daisy-chained boosting devices.

Figure 1:
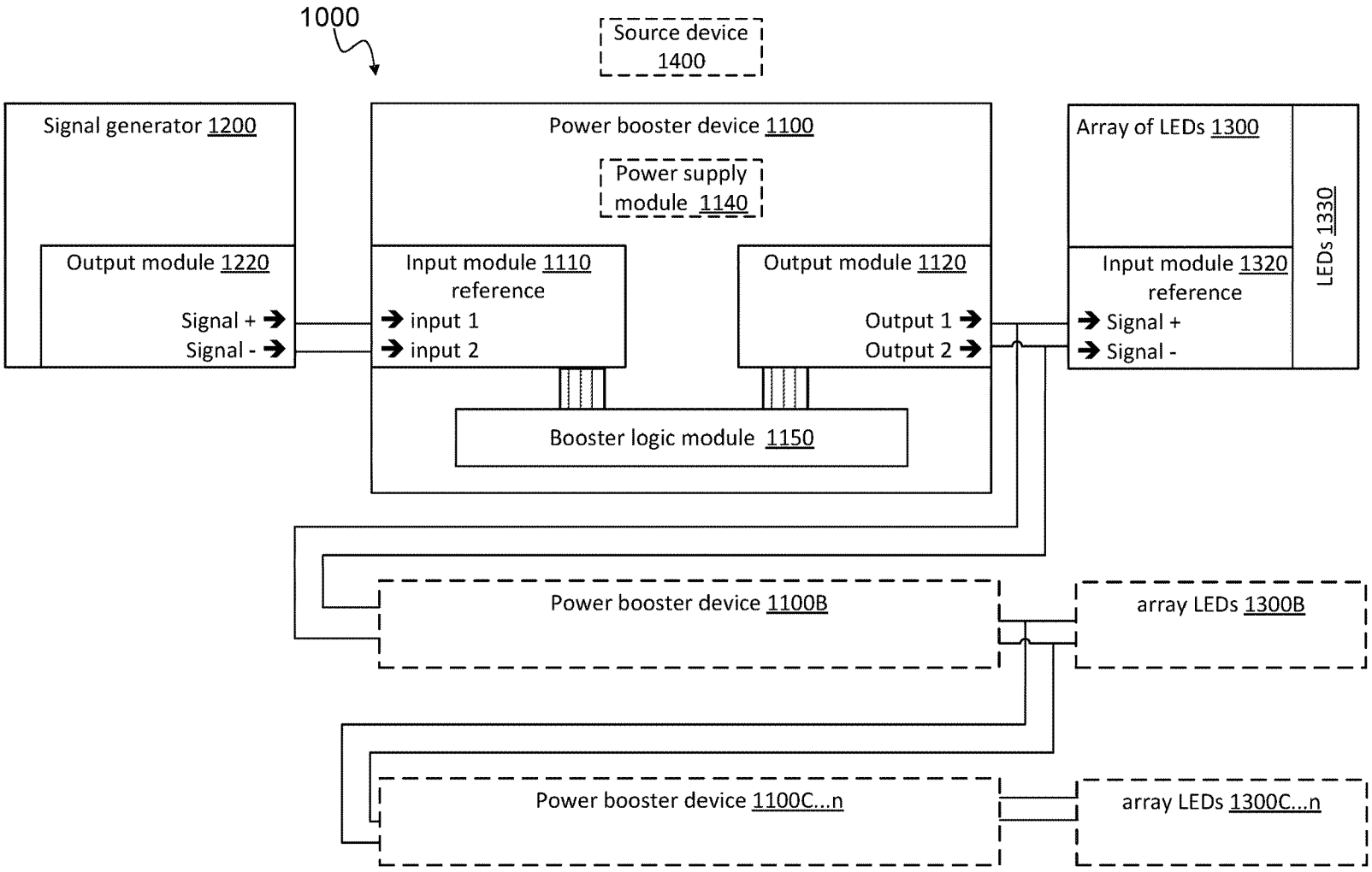
FIG. 1 is a logical modular representation of signal-conveying lighting system in accordance with the teachings of the present invention.

Reference is now made to the drawings in which FIG. 1 shows a modular representation of an exemplary lighting system 1000 comprising an exemplary power-booster device 1100 in accordance with the teachings of the present invention. The signal-preserving booster 1100 comprises an input module 1110 comprising a reference port (e.g., connected to the ground) and two input ports for receiving an input light signal therebetween. For instance, the input light signal may be provided by a signal generator 1200. The input light signal conveys an input lighting power component at a first power level and conveys a data-over-light digital stream component at a frequency imperceptible to a human eye. Both components of the input light signal may simply be provided together (i.e., the waveform of the input light signal conveys the data-over-light digital stream component while the amplitude of the input light signal conveys the input lighting power component). The signal-preserving power booster 1000 also comprises booster logic module

1150 providing an output signal from a first output port and a second output port. The booster logic module 1150 as exemplified is implemented through one or more electronic components mounted on a printed circuit board (e.g., a circuit of electronic components and/or one or more specialized processor). In one embodiment exemplified on FIG. 2, the booster logic module 1150 comprises a metal oxide semiconductor field-effect transistor (MOSFET) amplifier module 1152, having access to the reference port (e.g., connected to the ground also connected to the input module 1110). The MOSFET amplifier module 1152 comprises two output ports for providing an output light signal therebetween. A first output port of the two output ports is connected to an internal amplifier circuit 1154 connected to the first input port and a second output port of the two output ports is connected to the second input port. The output light signal preserves and conveys the data-over-light digital stream component from the input light signal and conveys an output lighting power component, at a second power level equal to or greater than the first power level. The output light signal powers a first array of Light Emission Diodes (LEDs) 1300 at the second power level.

Figure 2:
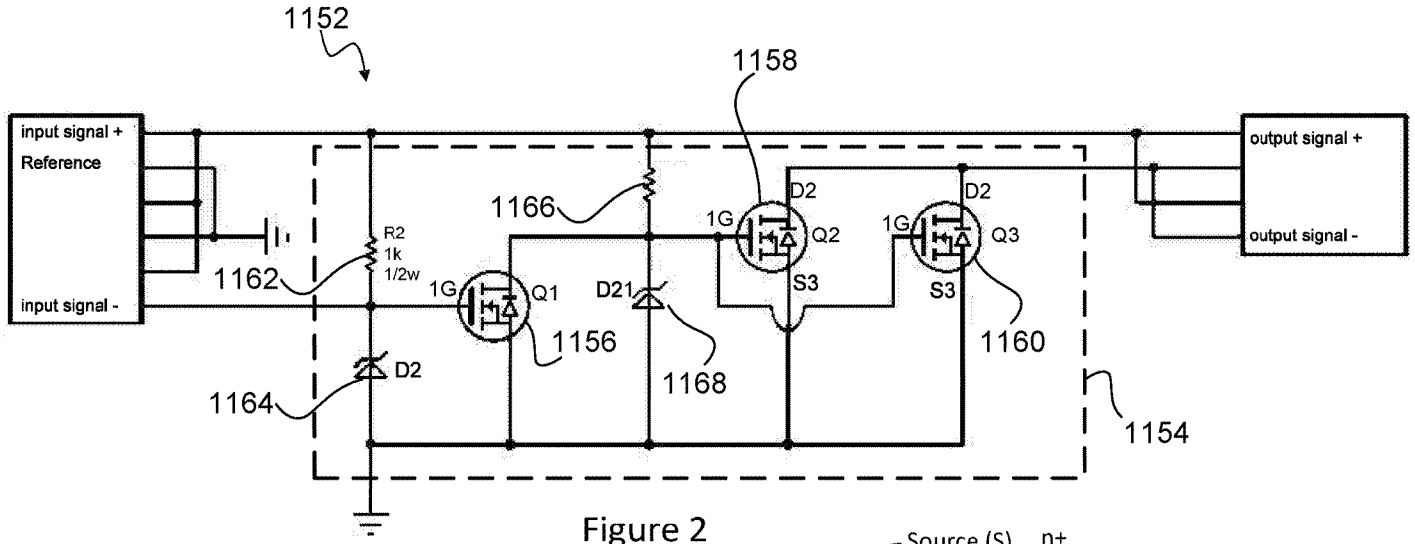
FIG. 2 is a logical representation of an exemplary MOSFET boosting circuit in accordance with the teachings of the present invention.
Figure 4:
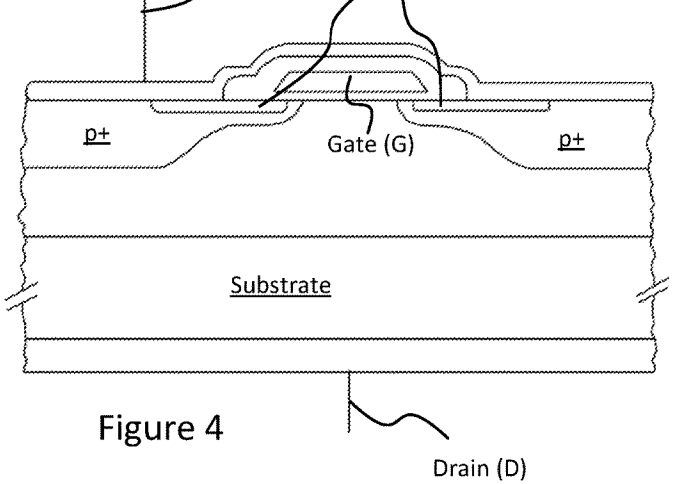
FIG. 4 is a physical representation of the exemplary MOSFET compatible with the teachings of the present invention.
Figure 3:
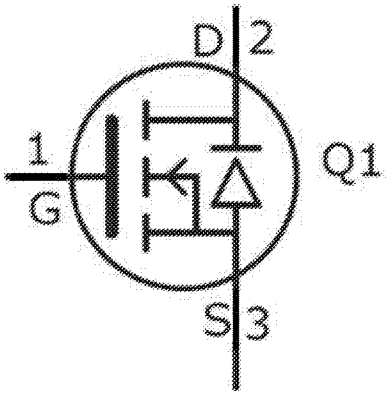
FIG. 3 is a logical representation of an exemplary MOSFET compatible with the teachings of the present invention.

As depicted in the example of FIG. 1 and FIG. 2, the internal amplifier circuit 1154 comprises a plurality MOSFETs, each providing a source, a gate, a drain and a channel. FIG. 3 and FIG. 4 provide an exemplary MOSFET compatible with the internal amplifier circuit 1154 of FIG. 2. A single type of MOSFET is selected for the three MOSFETs 1156, 1158 and 1160 that each provides a logical connection between the channel and the source and a logical diode connection from the source to the drain, as better seen on the example depicted in FIG. 3 and FIG. 4.

The first of the two input ports (labelled input signal−) is provided to the gate of a first MOSFET of the plurality of MOSFETs. The drain of the first MOSFET is provided to the gate of a second MOSFET 1158 of the plurality of MOSFETS and to the gate of a third MOSFET 1160 of the plurality of MOSFETS. A first voltage regulator comprising a first resistor 1162 (e.g., 1 kΩ resistance, ½ W power rating) and a first Zener diode 1164 connects the reference port, the first input port (input signal−) and the second input port (labelled input signal+). A second voltage regulator comprising a second resistor 1166 (e.g., 1 kΩ resistance, ½ W power rating) and a second Zener diode 1168 connects the reference port, the drain of the first MOSFET and the second input port (input signal+). The drain of the second MOSFET 1158 and the drain of the third MOSFET 1160 are provided to the first output port (labelled output signal−). As previously noted, the second output port (labelled output signal+) of the two output ports is connected to the second input port (labelled input signal+).

Figure 5:
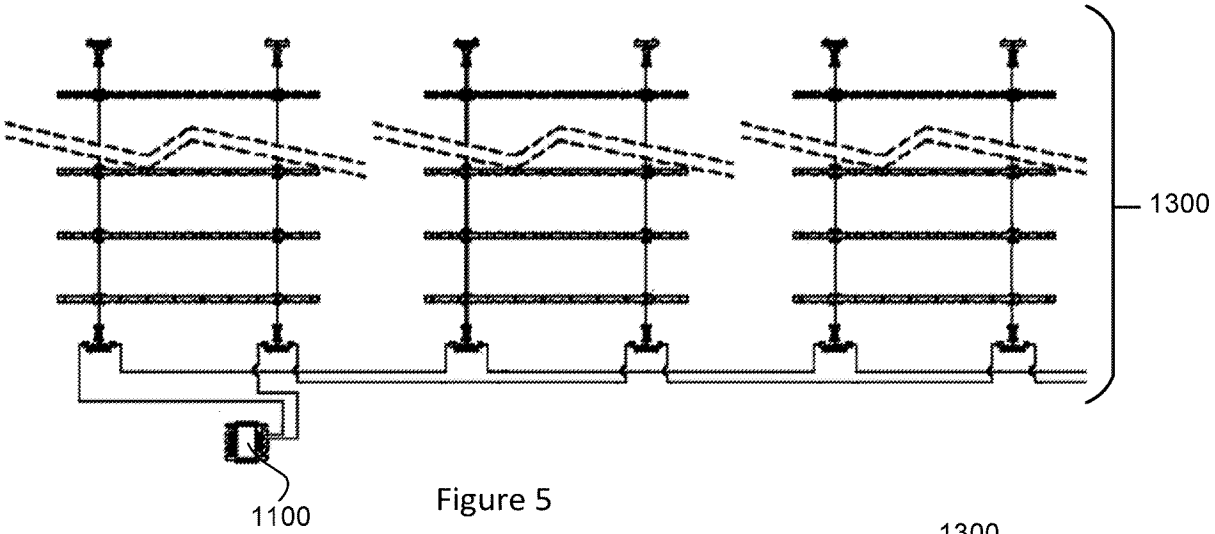
FIG. 5 is an exemplary signal-conveying lighting system in accordance with the teachings of the present invention.

In exemplary scenarios, a power supply 1140 may be integrated with the booster device 1100 or an external source device (1400) may be included in the system 1000 to ultimately provide the necessary power to the LEDs arrays 1330 of the LED array 1300. The LED array 1300 may comprise one or more column of LEDs, as exemplified on FIG. 5. Skilled person will recognize that different arrangements of the power supply 1240/source device 1400 could be provided. It is important to note, however, that the different LEDs arrays 1300 . . . n do not require an external power supply and only the booster device 1100 is required to be powered, thereby simplifying on-site wiring. In some embodiments, the external source device 1400 connects the second input port (input signal+) and the reference port (ground) and provides power to the generator device 1200, which in turn provides the input light signal at the first power level between the first input port (input signal−) and the second input port (input signal+) or a dedicated additional signal port (not shown). In other embodiments, the external source device 1400 provides power to the generator device 1200, which in turn provides the reference as well as the input light signal at the first power level between the first input port (input signal−) and the second input port (input signal+), and may also further provide a power from the source to an additional input port (not shown). A second booster 1100B, similar to the depicted one, may be connected to the reference port with the output light signal from the first booster 1100 connected as a second input light signal of the second booster 1100B. The second booster 1100B produces a second output light signal conveying the data-over-light digital stream component from the output light signal from the first booster 1100 and a second output lighting power component, at a third power level equal to or greater than the second power level. The second output light signal powering a second array of LEDs 1300B at the third power level.

Figure 6:
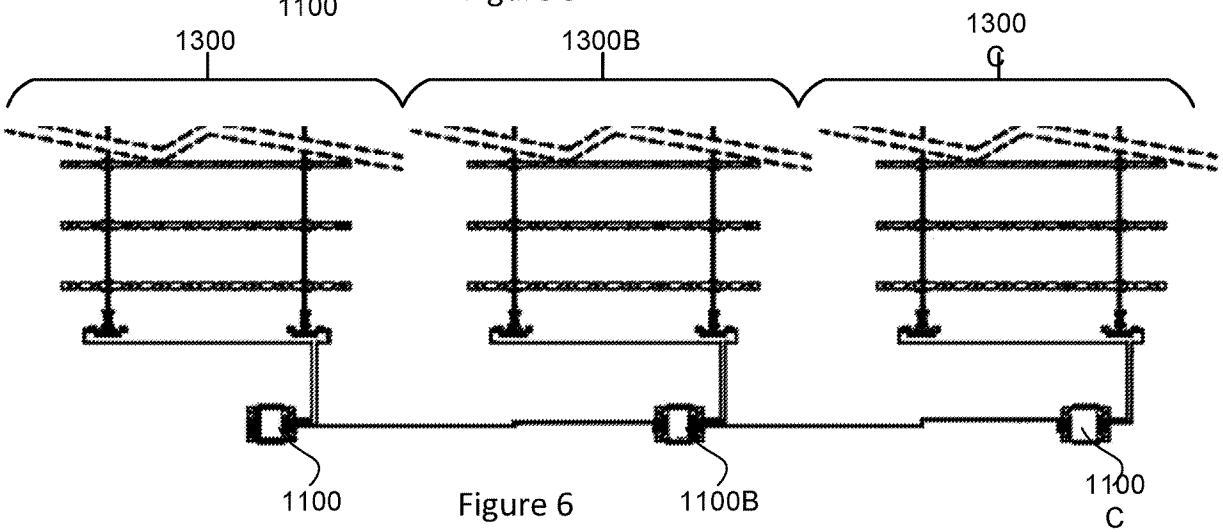
FIG. 6 is an exemplary signal-conveying lighting system in accordance with the teachings of the present invention.
Figure 7:
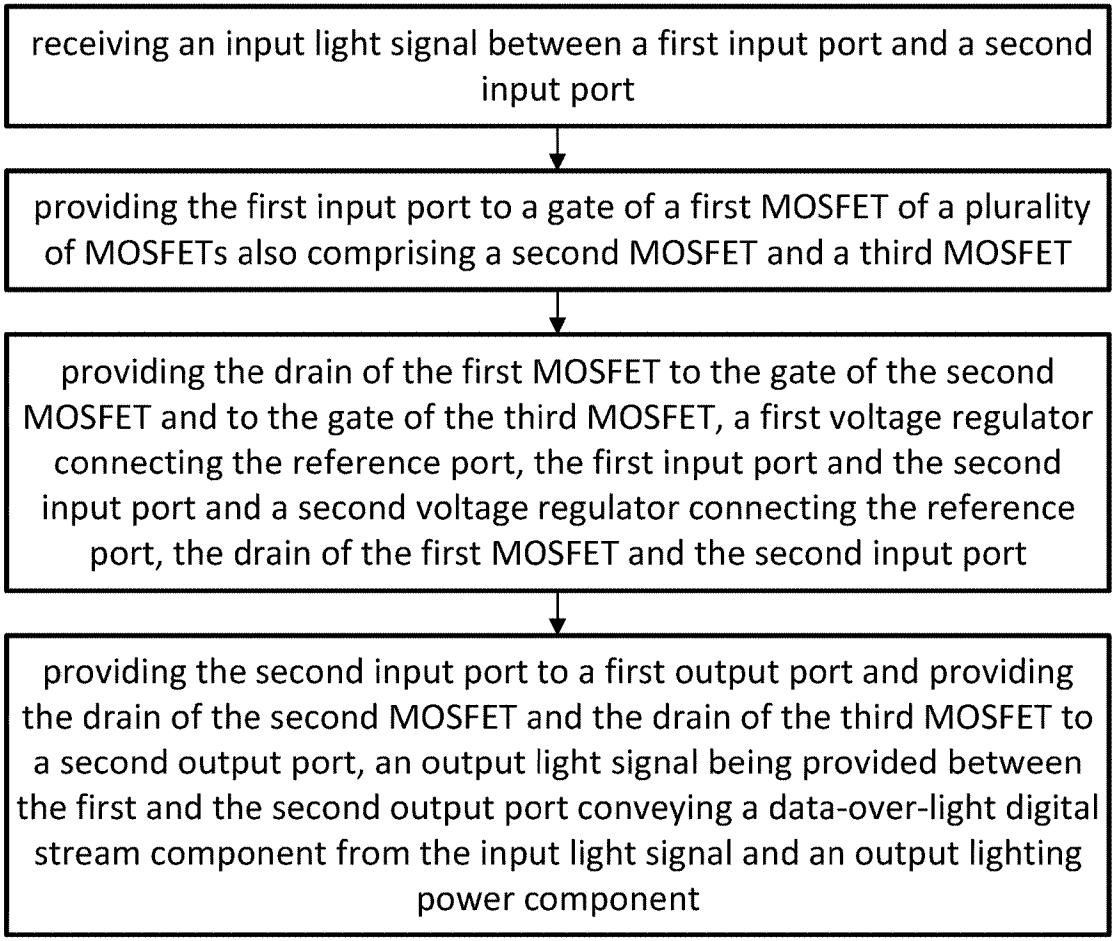
FIG. 7 is a flowchart an exemplary method in accordance with the teachings of the present invention.

In some embodiments, as depicted on FIG. 1 and FIG. 6, multiple additional boosters 1100C . . . n are provided, each similar to the depicted booster 1100, and are daisy-chained to the reference port with the output light signal connected as a daisy-chained input light signal of a first one of the additional boosters. Each of the plurality of daisy-chained boosters provides a corresponding output signal fed to a subsequent of the plurality of additional boosters. Each of the corresponding output signal conveys the data-over-light digital stream component from a precedent output light signal and a corresponding output lighting power component, at a subsequent power level equal to or greater than a second power level of a precedent of the plurality of additional boosters, the corresponding output light signal powering a corresponding array of LEDs 1300C at the corresponding power level. As skilled persons will readily recognize, the number of additional boosters that can be daisy-chained may be limited by a power rating of the source device 1400 or power supply 1240. The different arrays of LEDs 1300A . . . n may represent a single display panel (e.g., each array being provided as one of many columns in the display panel) or may also represent different display panels (e.g., facing each other, back to back, at 90° or in different locations altogether).

In some embodiments, a method 8000 is also provided for boosting power of an input light signal received between a first input port and a second input port. The input light signal conveys an input lighting power component at a first power level and a data-over-light digital stream component at a frequency imperceptible to a human eye.

The method 8000 comprises providing 8100 the first input port to a gate of a first metal oxide semiconductor field-effect transistor (MOSFET) of a plurality of MOSFETs comprising a second MOSFET and a third MOSFET. Each of the plurality of MOSFETS provides a source, a gate, a drain and a channel. A logical connection links the channel and the source and a logical diode connects from the source to the drain. The method 8000 also comprises providing 8200 the drain of the first MOSFET to the gate of the second MOSFET of the plurality of MOSFETS and to the gate of the third MOSFET of the plurality of MOSFETS. A first voltage regulator comprising a first resistor and a first Zener diode connects the reference port, the first input port and the second input port and a second voltage regulator comprising a second resistor and a second Zener diode connects the reference port, the drain of the first MOSFET and the second input port.

The method 8000 then follows with providing 8300 the second of the two input ports to a first of the output ports and providing the drain of the second MOSFET and the drain of the third MOSFET to a second of the two output ports. An output light signal is provided between the first output port and the second output port conveying the data-over-light digital stream component from the input light signal and an output lighting power component, at a second power level greater than the first power level.

A method is generally conceived to be a self-consistent sequence of steps leading to a desired result. These steps require physical manipulations of physical quantities. Usually, though not necessarily, these quantities take the form of electrical or magnetic/electromagnetic signals capable of being stored, transferred, combined, compared, and otherwise manipulated. It is convenient at times, principally for reasons of common usage, to refer to these signals as bits, values, parameters, items, elements, objects, symbols, characters, terms, numbers, or the like. It should be noted, however, that all of these terms and similar terms are to be associated with the appropriate physical quantities and are merely convenient labels applied to these quantities.

Figure 8:
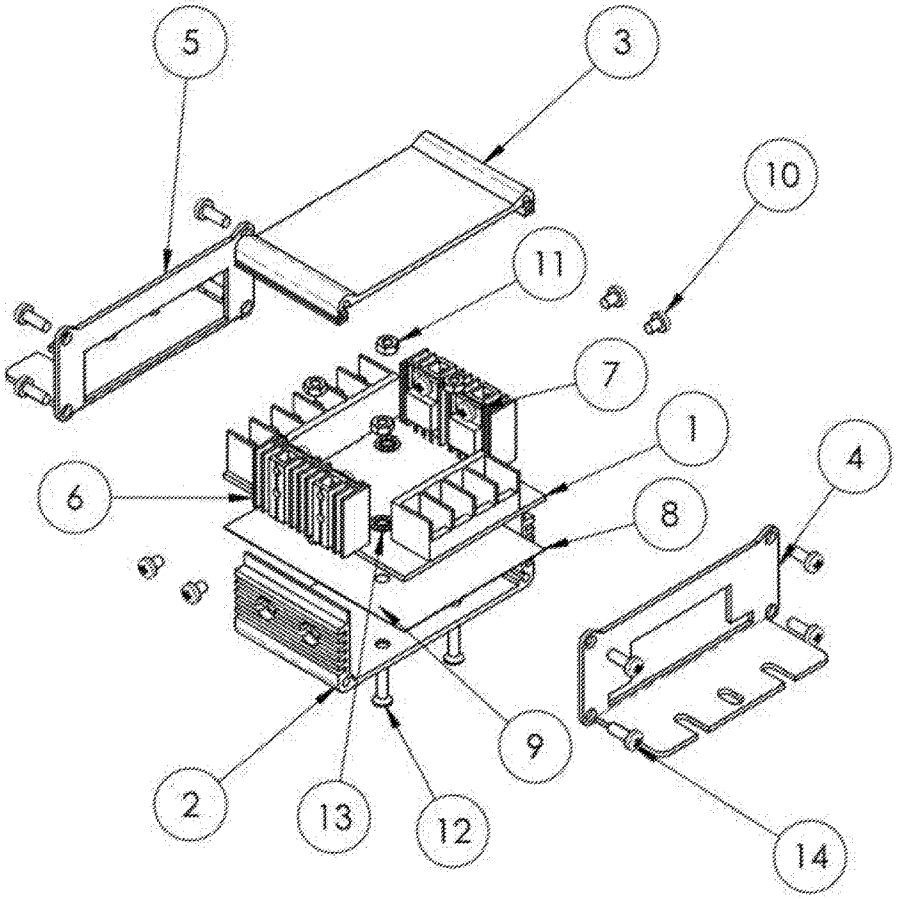
FIG. 8 is a perspective exploded view of an exemplary signal-preserving power booster device in accordance with the teachings of the present invention.
Figure 9:
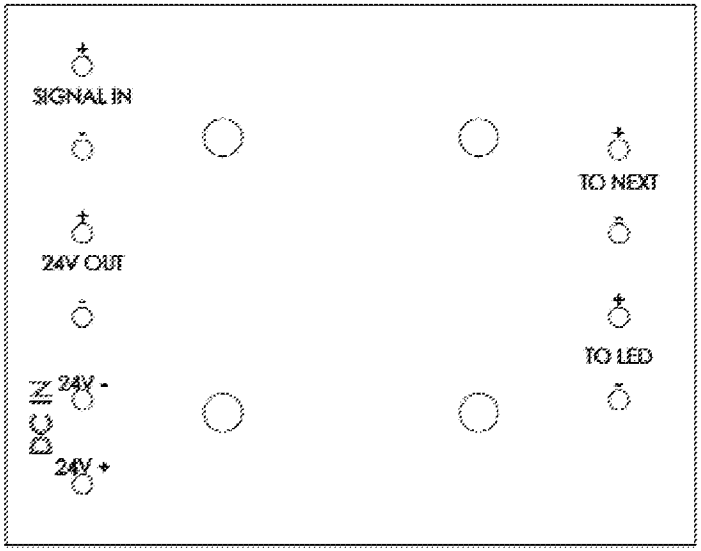
FIG. 9 is a top view of an exemplary mapping of the input/output ports of an exemplary signal-preserving power booster device in accordance with the teachings of the present invention.

FIG. 8 depicts one exemplary assembly for the signal booster 1100. The following part numbers are assigned on the example of FIG. 8:

1: PCB Board and Terminal 6 and 4
2: Main Box, Extruded Aluminum
3: Cover Box, Extruded Aluminum
4: Bracket 4 Ter, Aluminum Sheet
5: Bracket 6 Ter, Aluminum Sheet
6: Heat Sink, Extruded Aluminum Anodized
7: Resistor
8: Insulator, Plastic
9: Washer, Plastic
10: Screw Pan Head; M3×0.5×4
11: Hex Nut; M3×0.5
12: Screw Pan Head—M3×0.5×13
13: Internal Tooth Lock Washers
14: Screw Pan Head M3×0.5×8

As can be appreciated, the example of FIG. 8 provides a flexible structure that allows heat generated during signal-preserving power boosting to be evacuated (e.g., through the heat sink 6).

The description of the present invention has been presented for purposes of illustration but is not intended to be exhaustive or limited to the disclosed embodiments. Many modifications and variations will be apparent to those of ordinary skill in the art. The embodiments were chosen to explain the principles of the invention and its practical applications and to enable others of ordinary skill in the art to understand the invention in order to implement various embodiments with various modifications as might be suited to other contemplated uses.

What is claimed is:

1. A signal-preserving power booster comprising:

an input module comprising a reference port and two input ports for receiving an input light signal therebetween, the input light signal conveying:

an input lighting power component at a first power level; and a data-over-light digital stream component at a frequency imperceptible to a human eye; and a metal oxide semiconductor field-effect transistor (MOSFET) amplifier module, having access to the reference port, comprising two output ports for providing an output light signal therebetween, a first output port of the two output ports being connected to an internal amplifier circuit connected to the first input port and a second output port of the two output ports being connected to the second input port, wherein the output light signal conveys:

the data-over-light digital stream component from the input light signal; and an output lighting power component, at a second power level equal to or greater than the first power level, the output light signal powering a first array of Light Emission Diodes (LEDs) at the second power level.

2. The booster of claim 1, wherein the internal amplifier circuit comprises a plurality MOSFETs, each providing a source, a gate, a drain and a channel, wherein a logical connection links the channel and the source and a logical diode connects from the source to the drain, wherein:

the first of the two input ports is provided to the gate of a first MOSFET of the plurality of MOSFETs;

the drain of the first MOSFET is provided to the gate of a second MOSFET of the plurality of MOSFETS and to the gate of a third MOSFET of the plurality of MOSFETS;

a first voltage regulator comprising a first resistor and a first Zener diode connects the reference port, the first input port and the second input port;

a second voltage regulator comprising a second resistor and a second Zener diode connects the reference port, the drain of the first MOSFET and the second input port; and the drain of the second MOSFET and the drain of the third MOSFET are provided to the first output port.

3. The booster of claim 2, wherein a source device connects the second input port and the reference port and provides power to a generator device providing the input light signal at the first power level between the first input port and the second input port.

4. The booster of claim 3, wherein a second booster is connected to the reference port with the output light signal connected as a second input light signal of the second booster, a second output light signal conveying:

the data-over-light digital stream component from the output light signal; and a second output lighting power component, at a third power level equal to or greater than the second power level, the second output light signal powering a second array of LEDs at the third power level.

5. The booster of claim 4, wherein the source device connects a second input port of the second booster and the reference port and serves as a single source of energy for the first array of LEDs and the second array of LEDs.

6. The booster of claim 1, wherein a source device connects the second input port and the reference port and provides power to a generator device providing the input light signal at the first power level between the first input port and the second input port.

7. The booster of claim 6, wherein a second booster is connected to the reference port with the output light signal connected as a second input light signal of the second booster, a second output light signal conveying:

the data-over-light digital stream component from the output light signal; and a second output lighting power component, at a third power level equal to or greater than the second power level, the second output light signal powering a second array of LEDs at the third power level.

8. The booster of claim 7, wherein the source device connects a second input port of the second booster and the reference port and serves as a single source of energy for the first array of LEDs and the second array of LEDs.

9. The booster of claim 6, wherein a plurality of additional boosters are daisy chained to the reference port with the output light signal connected as a daisy-chained input light signal of a first one of the plurality of additional boosters, wherein each of the plurality of daisy-chained boosters provides a corresponding output signal fed to a subsequent of the plurality of additional boosters, wherein each of the corresponding output signal conveys:

the data-over-light digital stream component from a precedent output light signal; and a corresponding output lighting power component, at a subsequent power level equal to or greater than a second power level of a precedent of the plurality of additional boosters, the corresponding output light signal powering a corresponding array of Light Emission Diodes (LEDs) at the corresponding power level;

wherein a number of units in the plurality of additional boosters is limited by a power rating of the source device, which serves as a single source of energy for the first array of LEDs and the corresponding arrays of LEDs.

10. A method for boosting power of an input light signal towards two output ports, the method comprising:

receiving the input light signal between a first input port and a second input port, the input light signal conveying:

an input lighting power component at a first power level; and a data-over-light digital stream component at a frequency imperceptible to a human eye;

providing the first input port to a gate of a first metal oxide semiconductor field-effect transistor (MOSFET) of a plurality of MOSFETs comprising a second MOSFET and a third MOSFET, each of the plurality of MOSFETS providing a source, a gate, a drain and a channel, wherein a logical connection links the channel and the source and a logical diode connects from the source to the drain;

providing the drain of the first MOSFET to the gate of the second MOSFET and to the gate of the third MOSFET, wherein a first voltage regulator comprising a first resistor and a first Zener diode connects a reference port, the first input port and the second input port and a second voltage regulator comprising a second resistor and a second Zener diode connects the reference port, the drain of the first MOSFET and the second input port;

providing the second input port to a second of the two output ports; and providing the drain of the second MOSFET and the drain of the third MOSFET to a first of the two output ports, wherein an output light signal is provided between the first output port and the second output port conveying:

the data-over-light digital stream component from the input light signal; and an output lighting power component, at a second power level greater than or equal to the first power level.

11. The method of claim 10, further comprising powering a first array of Light Emission Diodes (LEDs) at the second power level from the output light signal.

12. The method of claim 11, further comprising connecting a source device between the second input port and the reference port and connecting the source device to a generator device providing the input light signal at the first power level between the first input port and the second input port.

13. The method of claim 12, further comprising providing the output light signal to a second booster connected to the reference port with the output light signal connected as a second input light signal of the second booster, a second output light signal conveying:

the data-over-light digital stream component from the output light signal; and a second output lighting power component, at a third power level equal to or greater than the second power level, the second output light signal powering a second array of Light Emission Diodes (LEDs) at the third power level.

14. The method of claim 13, further comprising providing the second output light signal to a third booster to the reference port with the second output light signal connected as a third input light signal of the third booster, a third output light signal conveying:

the data-over-light digital stream component from the second output light signal; and a third output lighting power component, at a fourth power level equal to or greater than a third power level, the third output light signal powering a third array of Light Emission Diodes (LEDs) at the fourth power level.

15. The method of claim 12, further comprising daisy-chaining a plurality of additional boosters to the reference port with the output light signal connected as a daisy-chained input light signal of a first one of the plurality of additional boosters, wherein each of the plurality of daisy-chained boosters provides a corresponding output signal fed to a subsequent of the plurality of additional boosters, wherein each of the corresponding output signal conveys:

the data-over-light digital stream component from a precedent output light signal; and a corresponding output lighting power component, at a subsequent power level equal to or greater than a second power level of a precedent of the plurality of additional boosters, the corresponding output light signal powering a corresponding array of Light Emission Diodes (LEDs) at the corresponding power level;

wherein a number of units in the plurality of additional boosters is limited by a power rating of a source device, which serves as a single source of energy for the first array of LEDs and the corresponding arrays of LEDs.

* * * * *